United States Patent [19]

Davenport

[11] Patent Number: 4,494,045

[45] Date of Patent: Jan. 15, 1985

[54] BALLAST CIRCUIT FOR A 220-VOLT IMPROVED LIGHTING UNIT

[75] Inventor: John M. Davenport, Lyndhurst, Ohio

[73] Assignee: General Electric Company, Schenectady, N.Y.

[21] Appl. No.: 488,849

[22] Filed: Apr. 26, 1983

[51] Int. Cl.[3] ..... H05B 41/16; H05B 41/24

[52] U.S. Cl. ..... 315/247; 315/198; 315/207; 315/273

[58] Field of Search ..... 315/179, 187, 201, 247, 315/273, 237, 238, 230, 290, 252, 275, 188, 198, 310, 293, 158, DIG. 4; 363/100, 143

[56] References Cited

U.S. PATENT DOCUMENTS 4,320,325 3/1982 Anderson ..... 315/205

4,350,930 9/1982 Peil et al. ..... 315/49

FOREIGN PATENT DOCUMENTS 1413502 11/1968 Fed. Rep. of Germany ..... 315/252

*Primary Examiner*—David K. Moore

*Assistant Examiner*—J. Todd

*Attorney, Agent, or Firm*—John P. McMahon; Philip L. Schlamp; Fred Jacob

[57] ABSTRACT

A ballast circuit for developing a predetermined desired D.C. voltage to enhance the operation of a gas discharge tube in a lighting unit of the type which also comprises an incandescent filament is disclosed. The ballast circuit operates from an applied 220 volt, 50 Hz alternating current (A.C.) source. The ballast circuit has an input stage comprised of a resistive capacitive network. The resistive capacitive network has values selected so as to reduce the applied 220 volt, 50 Hz excitation to a desired range for further development by the ballast circuit in providing a desired D.C. operational voltage for the gas discharge tube. Further, the ballast circuit provides means to prevent circuit malfunctions due to sudden changes in the applied A.C. source voltage. Still further, the ballast circuit provides a desired power factor operation of the gas discharge tube.

4 Claims, 7 Drawing Figures

BALLAST CIRCUIT FOR A 220-VOLT IMPROVED LIGHTING UNIT

BACKGROUND OF THE INVENTION

The present invention relates to a ballast circuit for gas discharge lamps. More particularly, the present invention relates to a resistive ballast circuit particularly suitable for accepting a typical alternating current (A.C.) source of 220 volts at 50 Hz so as to develop a desired D.C. operating voltage for a gas discharge tube.

Recent improvements to the incandescent lamp art have provided an improved lighting unit having a highly efficient gas discharge tube as the main light source and an incandescent filament as a supplementary light source. Such an improved lighting unit is generally described in U.S. Pat. No. 4,350,930 of Piel et al, issued Sept. 21, 1982.

The gas discharge tube may be successfully operated by a ballast circuit developing a D.C. type operating voltage for the arc discharge tube. Such ballast circuits are as described in the previously mentioned U.S. Pat. No. 4,350,930 and also U.S. Pat. No. 4,320,325 of T. E. Anderson, issued Mar. 16, 1982.

The gas discharge tube has various modes of operation such as, (1) an initial high voltage breakdown mode, (2) a glow-to-arc transition mode, and (3) a steady state run mode. The desired operation of the arc discharge tube requires that certain circuit performance parameters of the ballast circuit be maintained for successful operation. The required circuit parameters of the ballast circuit are, among others, (1) in order to avoid lamp dropout, that is, conditions which cause the arc conditions of the gas discharge tube to extinguish so as to cause the gas discharge tube to revert from its steady state operating condition to its glow to arc mode or even to its breakdown mode, the excitation voltage applied to the ballast circuit of the gas discharge tube should always be of a value greater than the value required for the operational voltage of the gas discharge tube, and (2) the value of the difference voltage between the source voltage and the voltage applied to the gas discharge tube should always be such so as to prevent the current flowing in the gas discharge tube from dropping below a critical value, such as 60 milliamps, which if reached may cause the gas discharge tube to require a restrike voltage typically that having a value of 2.5 times that of D.C. operating voltage in order to establish the desired arc conditions of the gas discharge tube.

A further consideration for the ballast circuit for successful operation of the gas discharge tube of the improved lighting unit that should be taken into account is the ratio of the voltage applied and derived from an A.C. voltage source, between the supplementary light source filament and the primary light source efficient gas discharge tube. It is desired that the majority of voltage derived by the ballast circuit from the A.C. voltage source be applied to the primary gas discharge tube. The system efficiency of the ballast circuit may be expressed as the power delivered to the gas discharge tube divided by the power input to the ballast circuit and is desired to have a typical value of more than about 0.5. The associated circuit components along with the circuit parameter of the ballast circuit, such as one providing a D.C. operating voltage for the gas discharge tube, are selected so that a circuit efficiency of about 50 percent is achieved or exceeded.

A still further consideration is the power factor of the ballast circuit operating the gas discharge tube and incandescent filament. The power factor is commonly used as a measurement of the ratio between the total wattage consumed by a device and total line current and voltages that is made available from an A.C. power source. The power factor rating of a ballast circuit is indicative of the amount of useful work or wattage of the ballast circuit developed from the line current. The wiring capacity for carrying the current to the ballast current must be planned for the total line current that produces useful watts in addition to wasted current. In practice, for the discharge lamp considered herein, a power factor of about or exceeding 0.5 satisfies this desire.

Still further, it is desired that the lamp ballast circuit have an R.M.S. current less than or approximately in the order of the current of an incandescent lamp with comparable light output. The desired circuit efficiency and the desired power factor of the ballast circuit along with the associated values and wattage rating of the components of the ballast circuit are not maintainable if the improved lighting unit is first selected for operation of the excitation source from the typical U.S. domestic power source voltage of 120 volts, 60 cycles and then is utilized for operation with the European and elsewhere used power source voltage of 220 volts, 50 Hz. It is desired that means be provided so as to easily adapt a ballast circuit for gas discharge tubes having selected circuit relationships and associated circuit component having selected values and wattage rating relative to usage with a 120 volt, 60 Hz source so that the ballast circuit may also be used with a 220 volt, 50 Hz European power source while still maintaining both a desired circuit efficiency and a desired power factor rating for the ballast circuit.

Accordingly it is an object of the present invention to provide means that easily adapt ballast circuits selected for operation with a 120 volt, 60 Hz power source to accept and perform in a desired manner with a 220 volt, 50 Hz power source so that the gas discharge tube is successfully operated while still maintaining its desired circuit parameters of the ballast circuit.

These and other objects of the present invention will become more apparent upon consideration of the following description of the invention.

SUMMARY OF THE INVENTION

In accordance with the present invention a ballast circuit for a gas discharge tube particularly suitable for accepting an alternating current (A.C.) voltage source having a typical value of 220 volts at 50 Hz and developing a direct current (D.C.) operational voltage of a gas discharge tube is provided.

In one embodiment a lighting unit having a gas discharge tube as the main light source, a filament as a supplementary light source and in serial arrangement with the gas discharge tube, and a starting circuit for the gas discharge tube is disclosed. The lighting unit further comprises a resistive ballast circuit for the gas discharge tube which is adapted to accept across its first and second input terminal an applied alternating current (A.C.) voltage having a typical value of 220 volts at a frequency of 50 Hz. The ballast circuit has an output stage comprised of a parallel arrangement of a full-wave recitifier and a filter capacitor both for developing a D.C. operating voltage for the gas discharge tube. The full-wave rectifier has two input nodes one of which is connected to one of the input terminals and two output nodes connected across the output stage. The output stage is capable of accepting across its first and second output terminals the serial arrangement of filament and gas discharge tube. The ballast circuit further comprises a resistor-capacitor network 52 at its input stage connected between the other input terminal and other input node of the full-wave rectifier. The resistor-capacitor network has values selected so as to reduce the A.C. voltage source by a factor in the range of about 2 to about 1 in the development D.C. operating voltage of the gas discharge tube.

The subject matter which is regarded as the invention is particularly pointed out and distinctly claimed in the concluding portion of the specification. The invention, however, both as to its organization and method of operation, together with further objects and advantages thereof, may best be understood by reference to the following description taken in conjunction with the accompanying drawings.

DETAILED DESCRIPTION OF THE PREFERRED EMBODIMENT

Figure 1:
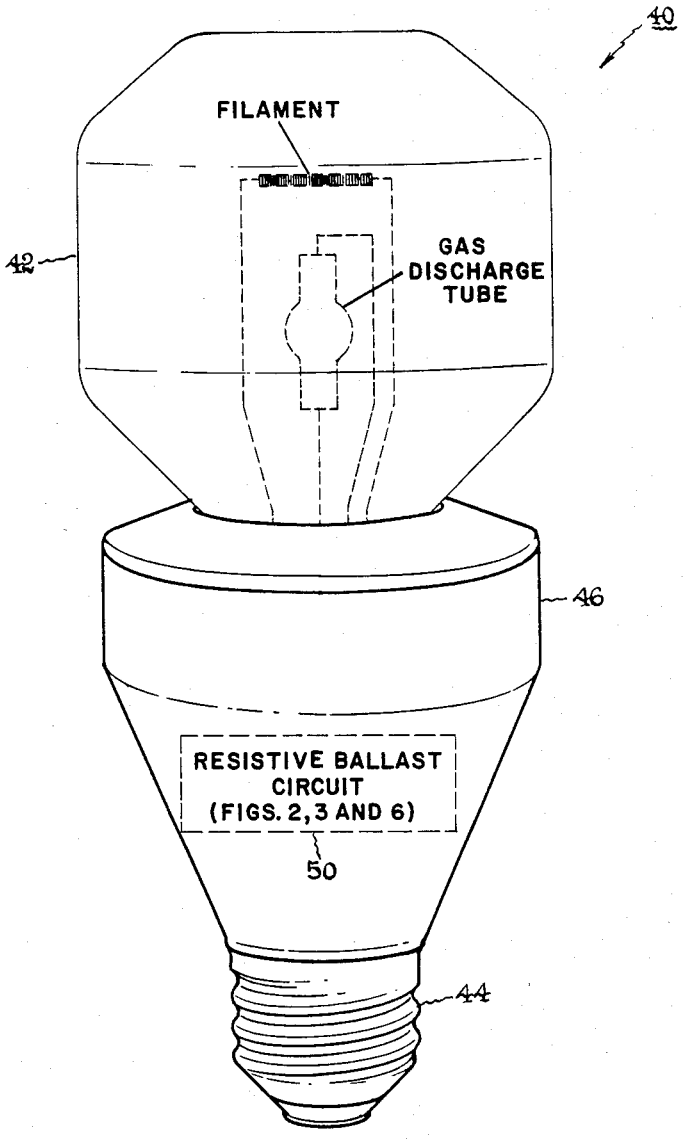
FIG. 1 shows a lighting unit in accordance with the present invention.

FIG. 1 shows a lighting unit 40 having a gas discharge tube (shown in phantom) as the main light source, and a filament as a supplementary light source (also shown in phantom) spatially disposed within a light-transmissive outer envelope 42. The lighting unit 40 has an electrically conductive base 44 and a housing 46 for lodging the electrical components of the lighting unit 10. FIG. 1 further shows the housing as confining a resistive ballast circuit 50 shown more clearly in FIG. 2.

Figure 2:
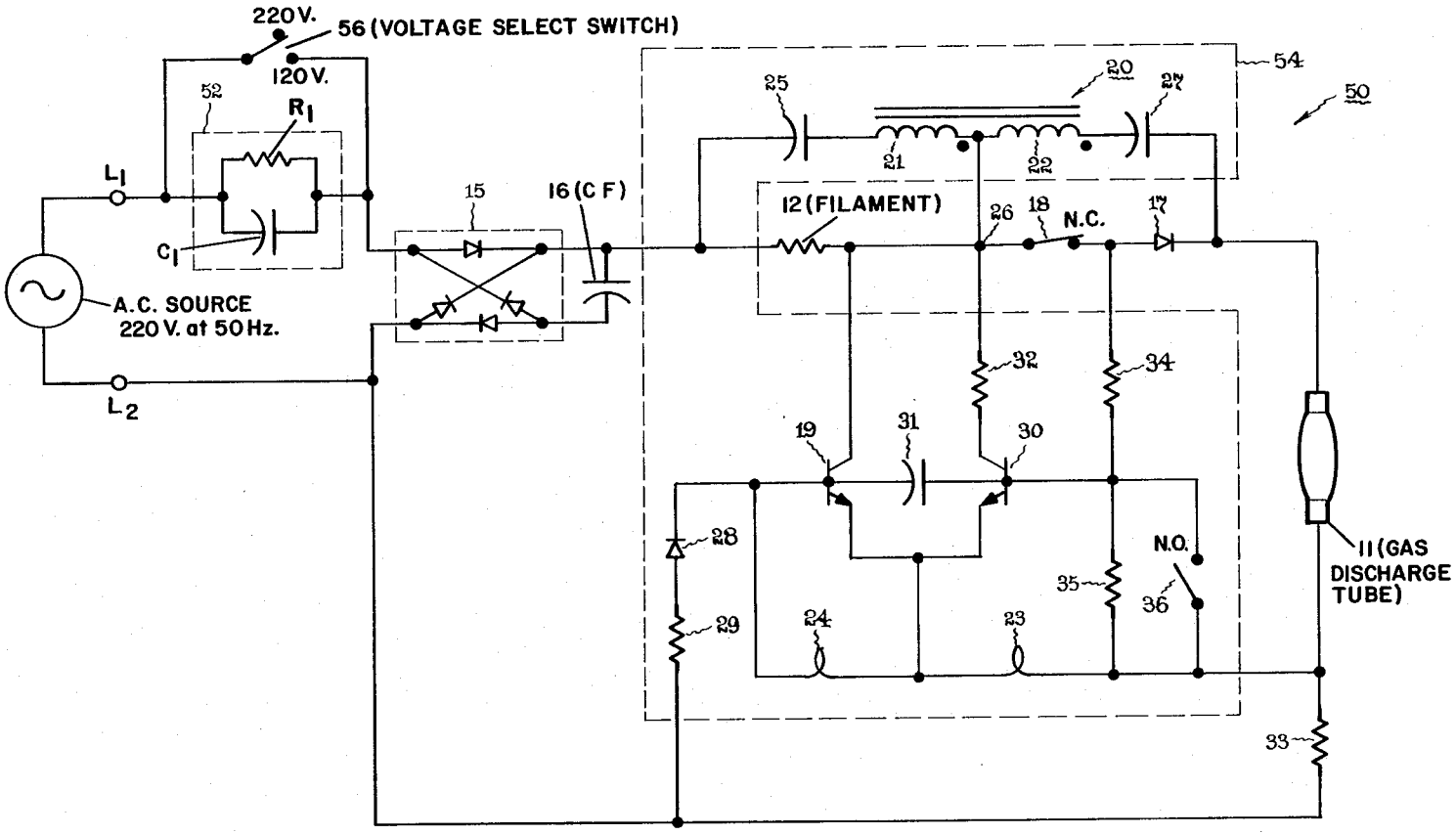
FIG. 2 is a circuit arrangement in accordance with one embodidment of the present invention.

FIG. 2 shows a resistor ballast circuit 50 for a gas discharge tube which may be of a low voltage high efficient type described in U.S. Pat. No. 4,161,672 of D. M. Cap and W. H. Lake, issued Jul. 17, 1979. The ballast circuit 50 is adapted to accept across its input terminals L1 and L2, having appropriate connections (not shown) to electrical conductive base 44, an A.C. source having a typical value of 220 volts at a frequency of 50 Hz. The ballast circuit 50 has an output stage comprised of a parallel arrangement of a full-wave rectifier 15 and filter capacitor 16 (CF) both operating to develop a D.C. operating voltage for the gas discharge tube. The full-wave rectifier 15 has two input nodes one of which is connected to the A.C. source via terminal L2, and the other connected to resistor-capacitor network 52. The full-wave rectifier 15 has two output nodes connected across a filter capacitor 16 (CF) having a typical value of 50 microfarads. The resistor-capacitor network 52 has a resistor R1 and a capacitor C1. The resistor-capacitor network 52 is selectably interconnected to the input terminal L1 by voltage select switching means 56. The switching means 56 may be selected to its 120 volt position which bypasses the resistor-capacitor network 52 or it may be selected to its 220 volt position interconnecting the resistor-capacitor 52 between terminal L1 and one of the input nodes of the full-wave rectifier 15. The voltage selection switching means is a normally closed type switch and is externally located on the lighting unit 40. When placed in its 120 volt position, switching means 56 allows the circuit arrangement of FIG. 2 to operate in a desired manner for an applied A.C. source voltage of 120 volts at 60 Hz. When switching means 56 is placed in its 220 volt position, the resistor-capacitor network 52 performs its desired functions to be described.

The output stage of the ballast circuit is coupled to a serial arrangement of the tungsten filament 12 and the gas discharge tube 11 having a starting circuit 54. The starting circuit 54 of FIG. 2 is comprised of a plurality of elements having the same reference numbers, circuit arrangement, and description given in U.S. Pat. No. 4,350,930 of W. Piel et al, which is herein incorporated by reference. Table 1 lists the reference numbers of the elements of the starting circuit 54 of FIG. 2 and also U.S. Pat. No. 4,350,930 along the component value or type of element.

TABLE 1

| Reference Numbers | Component Value or Type |
|---|---|
| 17 | Diode |
| 18 | Normally closed switch |
| 19 | Transistor-MJE 130005 |
| 20 | Ferrite autotransformer |
| 21 | Winding of transformer 20 |
| 22 | Winding of Transformer 20 |
| 23 | A feedback winding of autotransformer 20 |
| 24 | A feedback winding of autotransformer 20 |
| 25 | Capacitor of 0.033 microfarads |
| 26 | Interconnection terminal |
| 27 | Capacitor of 0.004 microfarads |
| 28 | Diode IN914 |
| 29 | Resistor of 20Ω |
| 30 | Transistor 2N6517 |
| 31 | Capacitor of 0.0047 microfarads |
| 32 | Resistor of 1 KΩ |
| 33 | Resistor of 2Ω |
| 34 | Resistor of 180 KΩ |
| 35 | Resistor of 1 KΩ |
| 36 | Normally-opened switch |

The starting circuit 54 provides the necessary voltages so as to transition the gas discharge tube from it (1) initial state requiring a relatively high applied voltage to cause an initial arcing condition of the gas discharge tube (2) to its glow-to-arc mode, and then (3) its final steady state run condition. The starting circuit 54 shown in FIG. 2 is not considered part of this invention but reference may be made for further details of such a starting circuit to the previously mentioned U.S. Pat. No. 4,350,930. The ballast circuit 50 is shown in FIG. 3 without the starting circuit 54.

As will be described hereinafter, the resistor-capacitor network 52 shown in FIGS. 2 and 3 has values selected so as to reduce the A.C. voltage source of 220 volts at 50 Hz by a factor in the range of about 2 to about 1 during the development of the D.C. operating voltage for the gas discharge voltage. The gas discharge tube is operated with the applied 220 volt 50 Hz source at about the same power and voltage characteristic as it might encounter for the applied source of 120 volts at 60 Hz. The resistor-capacitor network 52 provides, among other things, the means for adapting the associated circuit components of a resistive ballast circuit that develops a D.C. operating voltage for the gas discharge tube and has operating parameters selected for utilization with an applied A.C. source of 120 volts at 60 Hz, for utilization with an increased applied A.C. source of 220 volts and 50 Hz. The adapted operating parameters include, for example, the power factor rating of the ballast circuit, the D.C. operating voltage of the gas discharge tube and the values and wattage rating of all the circuit elements shown in FIGS. 2 and 3. The resistor-capacitor network 52 is of substantial importance to the present invention and in order that its operation may be more fully appreciated reference is made to a prior art ballast circuit shown in FIG. 4 which does not incorporate the present invention.

Figure 3:
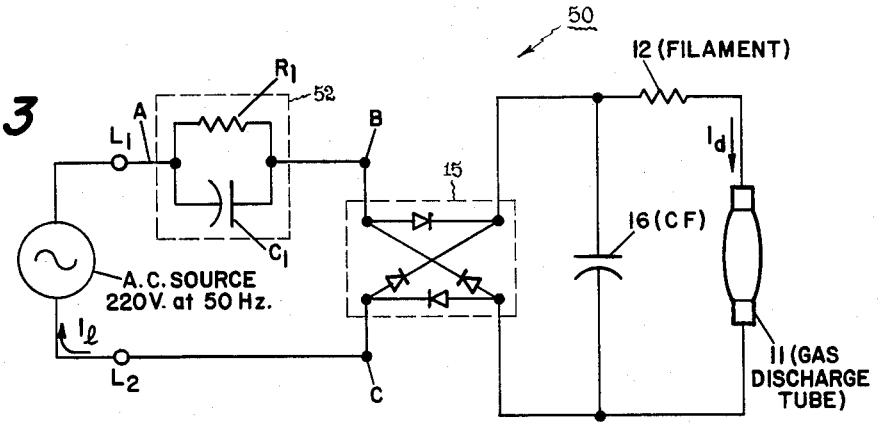
FIG. 3 is a circuit arrangement similar to FIG. 2 and shows the essential elements of the present invention.
Figure 4:
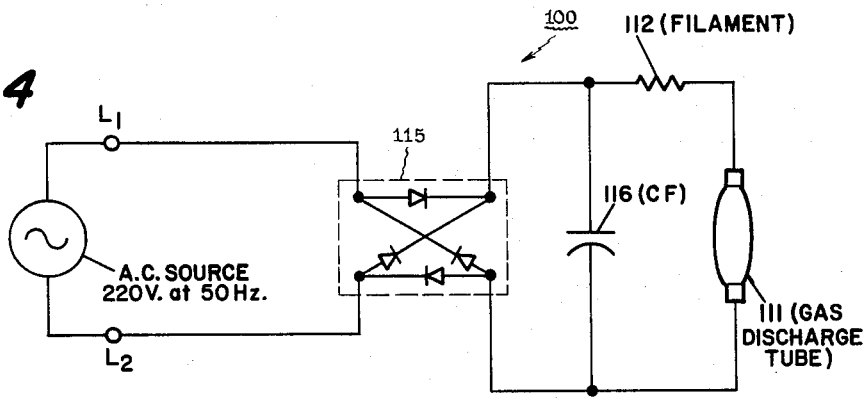
FIG. 4 is a prior art circuit arrangement for operating a gas discharge tube with a D.C. operating voltage.

FIG. 4 is similar to FIG. 3 except for its exclusion of the resistor-capacitor network 52 and uses the same reference numbers increased by a factor of 100 to show the similar elements described for FIGS. 2 AND 3. FIG. 4 shows a ballast circuit 100 such as that described in the previously mentioned U.S. Pat. No. 4,350,930 which has been reduced in such a manner that only its essential elements and their operating parameters may be more clearly compared to the ballast circuit 50 of the present invention.

The ballast circuit 100 has desired circuit parameters described in U.S. Pat. No. 4,350,930 selected so that the full-wave rectifier 115 accepts an A.C. source of 120 volts at 60 Hz and develops a corresponding D.C. rectifier voltage which is applied across capacitor 116 (CF), which, in turn, filters the D.C. rectifier voltage for application across the gas discharge tube 111 as its operating D.C. voltage. The ballast circuit 100 operates in the desired manner for the application of 120 volts at 60 Hz A.C. source. However, when the A.C. source is changed from 120 volts at 60 Hz to 220 volts at 50 Hz the selected design parameters become inadequate. For example, (1) the voltage and wattage ratings of the diodes of the full-wave rectifier 115 derive for 120 volts, 60 Hz application are inadequate for 220 volts, 50 Hz A.C. applications, (2) the voltage rating and the capacitive value of 116 (CF) derived for 120 volts at 60 Hz A.C. source are inadequate for 220 volts, 50 Hz A.C. applications, (3) the D.C. operating voltage which determines, in part, the life, maintenance and color rendition of the gas discharge tube derived for a rectified 120 volts, 60 Hz signal are inadequate for that derived from a rectified 220 volts A.C. 50 Hz signal, (4) the power factor rating of the ballast circuit 100, previously discussed in the "Background" section derived for a 120 volt, 60 Hz A.C. power source, is inadequate for a 220 volt, 50 Hz A.C. power source, and (5) the efficiency ratings of the ballast circuit derived for a 120 volt, 60 Hz A.C. source so as to provide the majority and minority of the voltage across the gas discharge and filament, respectively, is not maintainable for a 220 volt, 50 Hz source. Similar inadequacies may be typically experienced for a prior art ballast circuit described in U.S. application No. 463,753, filed Feb. 4, 1983, assigned to the same assignee as the present invention. All of these prior art inadequacies are obliviated by the ballast circuit 50 of FIG. 3.

FIG. 3 shows, (1) a point A located at the input to the resistor-capacitor network 52 which is connected to terminal L1, (2) a point B located at the output of the resistor-capacitor network 52, (3) a point C located at the input node of the full-wave rectifier 15 which is connected to terminal L2, (4) a symbol $I_1$ representing current circulating in the ballast circuit 50 and (5) $I_d$ which is the current flowing in the gas discharge tube. The voltages and currents related to the operation of the ballast circuit 50 of FIG. 3 are shown in FIG. 5.

Figure 5:
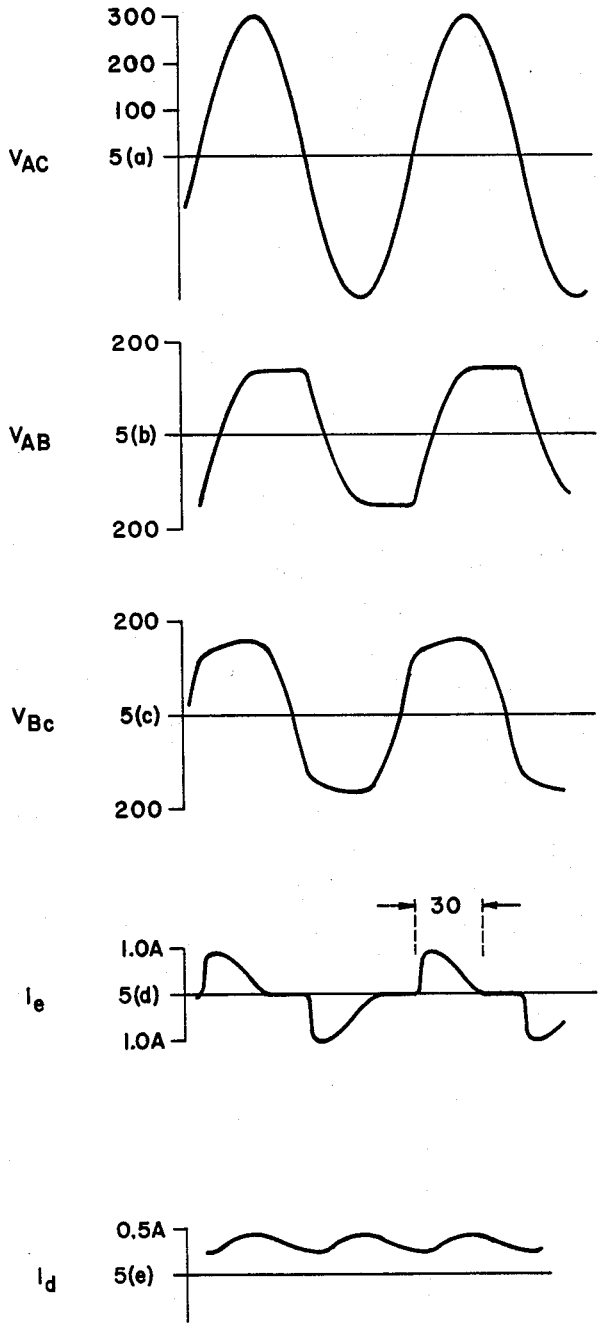
FIG. 5 shows the waveforms related to the circuit arrangement of FIG. 3.

FIG. 5 is segmented into five (5) sections, (1) FIG. 5*a* showing the line voltage of the 220 volt, 50 Hz excitation across terminals L1 and L2 and having a peak amplitude of about 300 volts, (2) FIG. 5*b* showing the voltage $V_{AB}$ which is the voltage of the resistor-capacitor network 52, and having a positive and negative values less than 200 volts, (3) FIG. 5*c* showing the voltage $V_{BC}$ which is the rectified voltage of the full-wave rectifier 15, and having positive and negative values less than 200 volts, (4) FIG, 5*d* showing the current $I_1$ flowing in ballast circuit 50, and (5) FIG. 5*e* showing the current $I_d$ flowing in the gas discharge tube.

From FIG. 5 the following observations are made, (1) the peak voltage value of $V_{BC}$ of FIG. 5*c* is less than about 160 volts which is well within the voltage rating of the diodes of the full-wave rectifier 15 and the filter capacitor 16 (CF) to which $V_{BC}$ is applied both selected for operating with an applied voltage of 120 volts, 60 Hz source, and (2) the peak voltage values of $V_{AB}$ of FIG. 5*b* is less than about 150 volts which is well within a voltage rating of the resistor-capacitor network 52 for both 120 volt components. The desired values of the voltage $V_{AB}$ and $V_{BC}$ of FIGS. 5*b* and 5*c*, respectively, are provided by the resistor R1 and capacitor C1 of network 52 have typical respective values of 40KΩ and 12 microfarads.

Further, it is seen that the current $I_d$ of FIG. 5*d*, more particularly, segment 30 of FIG. 5*d*, is relatively in phase with the $V_{AC}$ of FIG. 5*a* which provides a desired power factor of about 0.5. This desired power factor is obtained because the current $I_d$ is drawn from the line voltage $V_{AC}$ whenever the absolute value of the rectifier voltage $V_{BC}$ is greater than the voltage existing across the 50 microfarad capacitor. The resistor-capacitor 52 causes the voltage $V_{BC}$ to peak later in the cycle than it would have without the resistor-capacitor network 52 being interposed between the full-wave rectifier 22 and the terminal L1. The delayed peaking of $V_{BC}$ causes the current $I_d$ to be drawn for a longer time relative to that current that would be drawn if the $V_{BC}$ was derived directly from the sinewave type signal of 120 volts. Since the time duration of the current $I_d$ is approximately twice as long and the voltage is about twice as high for the circuit of FIG. 3 compared to the circuit of FIG. 4, the overall effect is that the power factor rating of the associated circuit components designed for a 120 volt A.C. 60 Hz source is preserved for utilization with a 220 volt, 50 Hz A.C. source.

Still further, the current $I_d$ of FIG. 5*e* is maintained above a desired critical value of 60 milliamps (ma) even though the applied $V_{AC}$ signal of FIG. 5*a* transitions through its zero conditions. If the current $I_d$ would fall below the critical value of 60 milliamps the gas discharge tube may revert to its glow-to-transition mode or even its initial mode. This reversion would necessitate the need for applying a restrike voltage in the order of 2.5 times the operating voltage of the gas discharge tube to restore the desired arc conditions of the gas discharge tube. The circuit arrangement of FIGS. 2 and 3 obviates the need of this restrike voltage.

Further still, the ballast circuit 50 of FIG. 4 having the waveforms of FIG. 5 distributes the voltages derived from the $V_A$ so that the majority of this voltage is applied across the main light source which is the gas discharge tube and a minority of this voltage is applied across the supplementary light source which is the filament. The circuit arrangement of FIGS. 2 and 3 provides its desired distribution so that a system efficiency of 50% or greater is typically achieved.

The ballast circuit 50 of FIG. 3 has a further desirable feature which provides protection against circuit malfunctions typically caused by transient conditions. These transient conditions may be experienced if the light switch controlling the 220 volt source application to the improved lighting unit of the present invention is quickly turned ON and then OFF or turned OFF and then ON. For such a momentary line interruption, it might be expected that the voltage $V_{AB}$ stored in the resistive-capacitive network 52 might be of its peak value such as 180 volts. Further it might be expected that this stored voltage of 180 volts may become additive to the peak line A.C. voltage of approximately 308 volts upon the restoration of the line voltage to the lighting unit. These values may become additive such as to cause 488 volts to be applied as the voltage $V_{BC}$ across the rectifier 15 causing damage to the diodes of the full-wave rectifier 15 or to the circuit elements coupled to full-wave rectifier 15. However, the circuit arrangement of FIGS. 2 and 3 never allows such a high voltage to be applied across the full-wave rectifier 15. This is accomplished because when the voltage $V_{BC}$ exceeds that of the voltage stored in the 50 microfarad capacitor 16 (CF), the full-wave rectifier bridge 15 is forward biased and the voltage $V_{BC}$ is discharged into the 50 microfarad capacitor 16 (CF). The 50 microfarad capacitor effectively absorbs the charge stored voltage in the 12 microfarad capacitor C1 of the resistive-capacitive network 52 so as to prevent any possible damage to the full-wave rectifier or to the circuit elements coupled to the full-wave rectifier 15 under these transient conditions.

Still further, the circuit arrangement of FIG. 3 provides protection against circuit malfunctions that may occur if 220 volt, 50 Hz source is suddenly removed from the improved lighting unit 40. This may occur if the plug supplying the A.C. source is suddenly removed. Under such conditions it might be expected that the capacitor C1 may have a stored voltage of its peak value of 180 volts, which, in turn, may be connected across terminals L1 and L2 having appropriate connections to the electric conductive base 44, of the lighting unit 40 thereby placing the electric conductive base at a relatively high potential of 180 volts. However, the circuit arrangement of FIGS. 2 and 3 prevents for such a condition by providing resistor R1 having a typical value of 40KΩ. The resistor R1 provides a relatively rapid discharge of 0.5 seconds for the embodiment shown. Further, if under these sudden removal conditions, the absolute value of the voltage $V_{BC}$ which is at the input node of the full-wave rectifier, is greater than the voltage at the output nodes of the full-wave rectifier, the possible stored energy in the capacitor C1 is rapidly discharged causing the absolute voltage across the input node to be less than the absolute voltage across the output thereby removing the undesired voltage potential present at the electrically conductive base is removed in a rapid manner.

It should now be appreciated that the practice of the present invention provides a resistive-capacitive network 52 that easily adapts an existing ballast circuit having circuit parameters selected for operation with a 120 volt, 60 Hz power source to accept and perform in a desired manner with a power source of 220 volts, 50 Hz so that the gas discharge tube is successfully operated while the desired circuit parameters of the ballast circuit are maintained. Further, the practice of the present invention provides against circuit malfunctions due to transient and sudden removal conditions of the applied 220 volts, 50 Hz power source.

Figure 6:
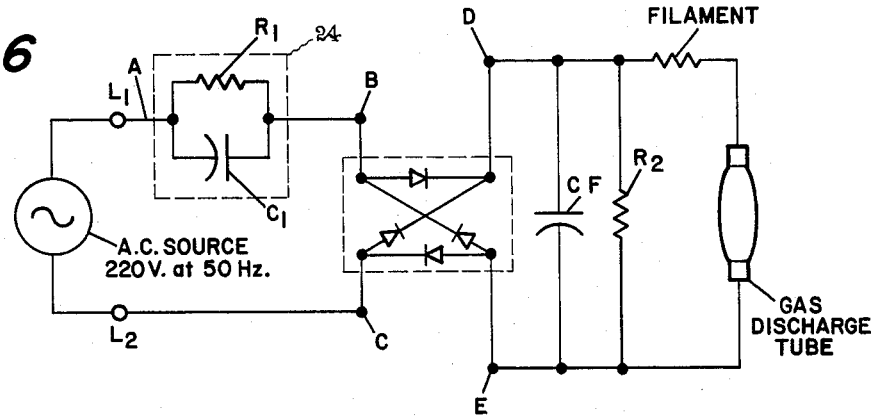
FIG. 6 shows an alternate embodiment of the present invention.

If desired, the ballast circuit 50 may be provided with a resistor R2 having a typical value of 50K arranged in such a manner shown in FIG. 6 so as to provide a resistive load to the ballast circuit 50 under filament burn-out or open conditions. During these filament burn-out conditions the voltage stored across the resistive-capacitor network 52, having typical values of 40KΩ and 12 microfarads, is much less than the voltage stored across the capacitor CF resistor R2 network having typical values of 50 microfarads and 50KΩ respectively. Under these conditions the diodes of the full-wave rectifier are placed in a back biased condition so that the voltage that may be existing across the gas discharge tube is discharged in an orderly manner.

The resistance R1 of the resistor-capacitor network 52 may be selected to have values which takes into consideration both a reasonable power drop across the resistor R1 and a reasonable time constant of the resistor-capacitor network 52. The resistor R1 may have a range of about 10K to 500K to satisfy these considerations.

The capacitor C1 of the resistor-capacitor network 52 may be selected to have a value which takes into consideration (1) the voltage value of the applied A.C. source, (2) the frequency of the applied A.C. source, and (3) the operating wattage of the gas discharge tube. The capacitor C1 may have a range of values best described with reference to FIG. 7.

Figure 7:
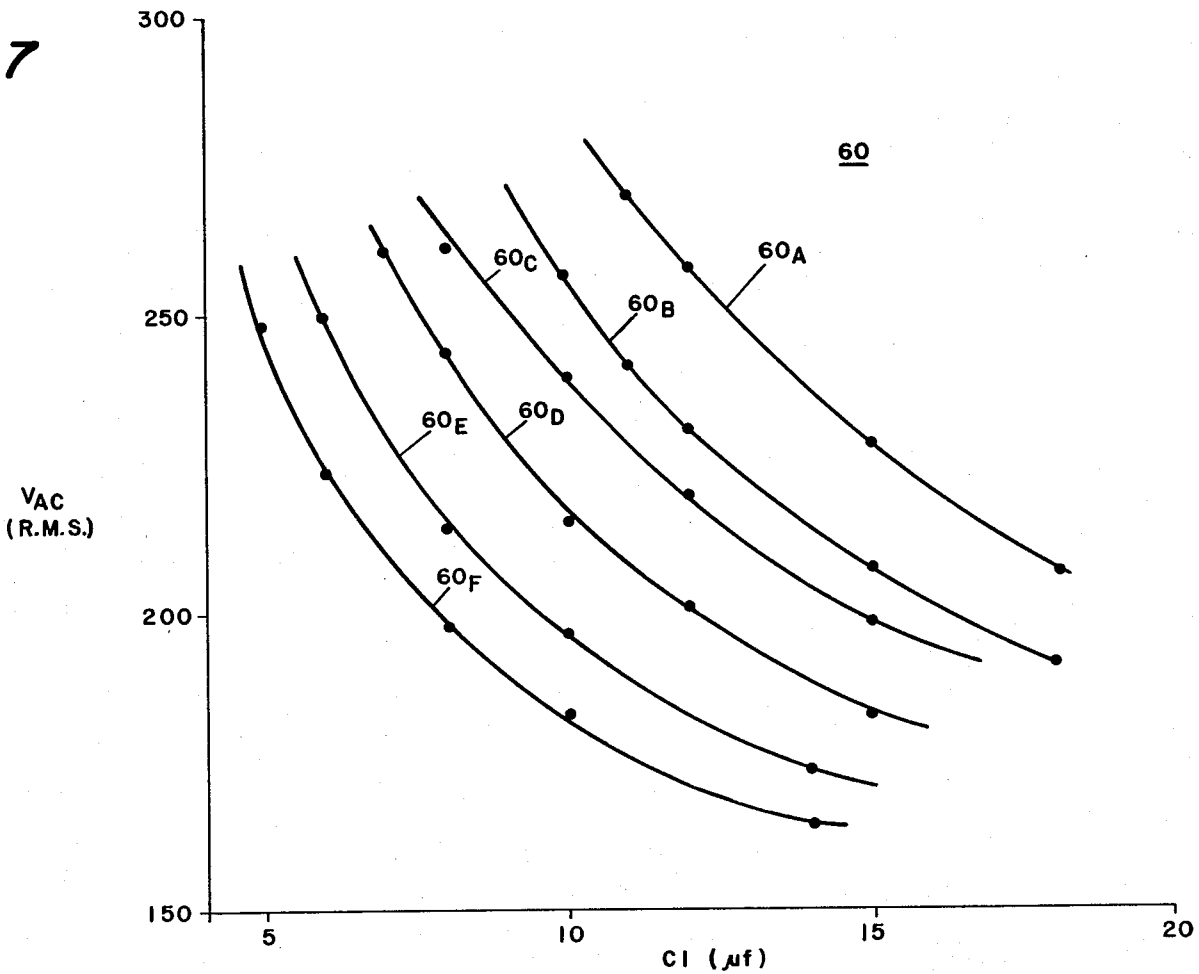
FIG. 7 is a family of curves related to the selection of the value of capacitor $C_1$ of the ballast circuit of the present invention.

FIG. 7 has a Y axis showing typical values (given in R.M.S.) of the applied A.C. source $V_{AC}$ and a X axis showing the range of the desired values (given in microfarads) of the capacitor C1. FIG. 7 further shows a family of curves 60 comprised of individual curves $\mathbf{60}_A$, $\mathbf{60}_B$, $\mathbf{60}_C$, $\mathbf{60}_D$, $\mathbf{60}_E$, and $\mathbf{60}_F$ having corresponding typical parameters related to the typical operating wattage of the gas discharge tube and typical frequency of the applied A.C. source $V_{AC}$ both given in Table 2.

TABLE 2

| Curve | Typical Wattage of the Gas Discharge Tube | Frequency of the $V_{AC}$ Source Voltage |
|---|---|---|
| $60_A$ | 44.2 | 50 Hz |
| $60_B$ | 44.2 | 60 Hz |
| $60_C$ | 31.1 | 50 Hz |
| $60_D$ | 31.1 | 60 Hz |
| $60_E$ | 20.0 | 50 Hz |
| $60_F$ | 20.0 | 60 Hz |

From the family of curves 60 of FIG. 7 it is seen that C1 may have a value selected in the range of about 4 microfarads to about 20 microfarads.

It should be appreciated that the present invention has many applications to relate it to single phase residental power services within the United States, within the European and Asiatic arenas and elsewhere. Still further, it should be appreciated that the present invention adapts the ballast circuit developed for a 120 volt, 60 cycle application to that of the 220 volt, 50 Hz application. Such adaptation is accomplished while preserving the life, maintenance and color characteristics of the arc discharge tube that may have been selected for 120 A.C. 60 Hz source utilization.

What I claim as new and desire to secure by Letters Patent of the United States is:

1. In a lighting unit having a gas discharge tube as the main light source, a filament as a supplementary light source and in serial arrangement with said discharge tube and a starting circuit for the gas discharge tube, a resistive ballast circuit for the gas discharge tube being adapted to accept across its first and second input terminals an applied alternating current (A.C.) voltage having a typical value of 220 volts at a frequency of 50 Hz, said ballast circuit having an output stage comprised of a parallel arrangement of a full-wave rectifier and a filter capacitor both for developing a D.C. operating voltage for the gas discharge tube, said full-wave rectifier having two input nodes one of which is connected to one of said input terminals and two output nodes connected across said output stage, said output stage being capable of accepting across its first and second output terminal said arrangement of said filament and said gas discharge tube, said ballast circuit further comprising a resistor-capacitor network at its input stage connected between one of the input terminals and the other input node of the full-wave rectifier;

said resistor-capacitor network having values selected so as to reduce the A.C. voltage by a factor in the range of about 2 to about 1 in the development of said D.C. operating voltage of said gas discharge tube.

2. In a lighting unit according to claim 1, said resistor-capacitor network further comprising a resistor selected to have a value in the range of about 10K to about 500K ohms.

3. In a lighting unit according to claim 1, said resistor-capacitor network further comprising a capacitor selected to have a value in the range of about 4 microfarads to about 20 microfarads.

4. In a lighting unit according to claim 1, said ballast circuit further comprising a resistor having a typical value of 50K in the range of about 10K to 500K and arranged in a parallel manner across said filter capacitor so that the discharge time constant of the filter capacitor is greater than that of the discharge time constant of the resistor-capacitor network.

* * * * *